US005099595A

United States Patent [19]

Chesnut et al.

[11] Patent Number: 5,099,595

[45] Date of Patent: Mar. 31, 1992

[54] MAGAZINE FOR A FIREARM

[75] Inventors: M. Gaines Chesnut, Golden; William L. Wood, Lakewood, both of Colo.

[73] Assignee: Ram-Line, Inc., Golden, Colo.

[21] Appl. No.: 533,585

[22] Filed: Jun. 5, 1990

[51] Int. Cl.[5] ..... F41A 9/69

[52] U.S. Cl. ..... 42/50

[58] Field of Search ..... 42/7, 18, 22, 50

[56] References Cited

U.S. PATENT DOCUMENTS

| | | | |
|---|---|---|---|
| 283,122 | 8/1883 | Lewis | 42/50 |
| D. 290,866 | 7/1987 | Chesnut | D22/108 |
| 303,992 | 8/1884 | Diss | 42/50 |
| 304,008 | 8/1884 | Krug | 42/50 |
| 313,856 | 3/1885 | Diss | 42/50 |
| 393,406 | 11/1888 | VonStepski et al. | 42/18 |
| 431,410 | 7/1890 | Speed | 42/50 |
| 562,455 | 6/1896 | Bye | 42/7 |
| 1,158,981 | 11/1915 | Carl | 42/50 |
| 1,200,685 | 10/1916 | Young | 42/7 |
| 1,323,063 | 11/1919 | Johnson et al. | 42/50 |
| 1,365,743 | 1/1921 | Stokke | 42/7 |
| 1,833,862 | 11/1931 | Schmeisser | 42/50 |
| 1,898,670 | 2/1933 | Laudensack | 42/18 |
| 2,217,848 | 10/1940 | Schillstrom | 42/50 |
| 2,311,497 | 2/1943 | Van Horn et al. | 42/50 |
| 2,441,735 | 5/1948 | Warner | 42/50 |
| 2,620,582 | 12/1952 | Stokes | 42/50 |
| 2,655,754 | 10/1953 | Brush | 42/50 |
| 2,777,235 | 1/1957 | Hopkins | 42/50 |
| 2,828,568 | 4/1958 | Sakewitz | 42/50 |
| 2,944,357 | 7/1960 | Smith et al. | 42/50 |
| 3,087,270 | 4/1963 | Stoner | 42/50 |
| 3,226,869 | 1/1966 | Musgrave | 42/50 |
| 3,345,771 | 10/1967 | Silsby | 42/18 |
| 3,383,790 | 5/1968 | Into | 42/50 |
| 3,399,480 | 9/1968 | Rowe, Jr. | 42/50 |
| 3,453,762 | 7/1969 | Fremont | 42/50 |
| 3,577,860 | 5/1971 | Jestrabek | 42/50 |
| 3,604,142 | 9/1971 | Silsby | 42/50 |
| 3,619,929 | 11/1971 | Fremont | 42/50 |
| 3,736,686 | 6/1973 | Moller et al. | 42/6 |
| 3,952,441 | 4/1976 | Tant | 42/50 |
| 3,977,114 | 8/1976 | Poor | 42/50 |
| 4,112,817 | 9/1978 | Bouriet | 89/33 |
| 4,127,954 | 12/1978 | Hausmann | 42/50 |
| 4,139,959 | 2/1979 | Howard et al. | 42/50 |
| 4,343,107 | 8/1982 | Kaltenegger | 42/7 |
| 4,366,638 | 1/1983 | Ketterer et al. | 42/50 |
| 4,446,645 | 5/1984 | Kelsey, Jr. et al. | 42/50 |
| 4,509,283 | 4/1985 | Chesnut | 42/50 |
| 4,566,212 | 1/1986 | Chesnut | 42/50 |
| 4,580,364 | 4/1986 | Vyprachticky | 42/50 |
| 4,586,281 | 5/1986 | Chesnut | 42/50 |
| 4,589,218 | 5/1986 | Teppa | 42/50 |
| 4,672,760 | 6/1987 | Chesnut et al. | 42/50 |
| 4,765,081 | 8/1988 | Dieringer | 42/50 |
| 4,776,122 | 10/1988 | Dieringer et al. | 42/50 |
| 4,790,094 | 12/1988 | Chesnut et al. | 42/50 |
| 4,811,510 | 3/1989 | Chesnut | 42/50 |
| 4,862,620 | 9/1989 | Chesnut et al. | 42/50 |
| 4,879,828 | 11/1989 | Dieringer et al. | 42/50 |
| 4,888,899 | 12/1989 | Chesnut | 42/50 |

FOREIGN PATENT DOCUMENTS

| | | | |
|---|---|---|---|
| 149137 | 11/1952 | Australia | 42/50 |
| 635534 | 7/1963 | Belgium | 42/50 |
| 90189 | 7/1897 | Fed. Rep. of Germany | 42/18 |
| 3305772 | 3/1982 | Fed. Rep. of Germany | 42/50 |
| 148470 | 1/1955 | Sweden | 42/50 |
| 235793 | 4/1945 | Switzerland | 42/50 |
| 241688 | 8/1946 | Switzerland | 42/50 |
| 406904 | 8/1966 | Switzerland | 42/50 |

*Primary Examiner*—Charles T. Jordan

*Attorney, Agent, or Firm*—Sheridan, Ross & McIntosh

[57] ABSTRACT

A magazine (10) stores a plurality of cartridges for sequential loading into a firearm (12). The magazine (10) comprises a storage zone (32), a transition zone (34), and a loading zone (36). The cartridges are configured in a double-X pattern in the storage zone (32) and a straight stack configuration in the loading zone (36). Rails (146 and 148) hold nose end portions of the cartridges while allowing rim ends of the cartridges to spread apart into contact with the sidewalls (42 and 44) of the storage zone (32). As the cartridge pass through the transition zone (34) the inwardly sloping sidewalls (56 and 58) bring the rim ends back together into the straight stack configuration.

44 Claims, 10 Drawing Sheets

MAGAZINE FOR A FIREARM

FIELD OF THE INVENTION

This invention relates in general to firearm accessories, and in particular to a magazine for use with a firearm.

BACKGROUND OF THE INVENTION

Magazines for use with semi-automatic firearms that use rim fire cartridges typically utilize some variation of one or two cartridge stacking arrangements. One typical arrangement of cartridges is a straight stack in which the rims of the cartridges are configured against a vertical end wall of the magazine. Another typical arrangement is the "banana clip" in which the rims of the cartridges are configured against an arcuate (banana) shaped end wall of the magazine.

An example of the straight stack arrangement is disclosed in U.S. Pat. No. 4,509,283 to Chesnut, in which vertical front and rear end walls of the magazine hold rim fire cartridges in a single straight stack. In such an arrangement, the first cartridge loaded into the magazine contacts a spring-loaded follower. The follower has a top surface formed at an angle relative to horizontal which approximately matches an angle between a longitudinal axis through the magazine well of the firearm relative to vertical. For example, if the angle between the longitudinal axis through the magazine well and vertical is 30 degrees, the angle of the follower surface and each cartridge therein relative to horizontal is also approximately 30 degrees. By matching the cartridge angle to the magazine well/vertical angle, a cartridge is effectively placed in a plane generally parallel to a plane passing through a longitudinal center line of the firearm chamber.

To allow a vertical arrangement of cartridges, it may be required to provide a loading assist knob on the follower. The knob is attached to the follower and passes through a slot in one of the sidewalls of the magazine. To load the magazine, the knob is engaged to depress the follower downwardly into the magazine as cartridges are inserted through an open top end thereof. Without the knob, frictional forces between the front and rear end walls of the magazine and the cartridges as well as the force from the follower spring tend to make it very difficult, if not impossible, to load more than a few cartridges into the magazine.

If the magazine well/vertical angle is varied, for example, to 20°, the vertical arrangement of cartridges tends to become impractical. However, it has been found that a 20° well/vertical angle provides a subjectively more natural aiming relationship of the firearm at the end of an extended human arm. When cartridges are placed in a vertical front and rear end wall magazine, having a follower angle of 20°, in a similar manner as per the '283 patent referenced above, the frictional forces between the cartridges and the front and rear end walls of the magazine may create upfeed problems which make the magazine inoperative after several rounds. Thus, to reduce the frictional forces the cartridges must be stacked in a different fashion to remove contact between the cartridges and the front or rear end wall.

Examples of a second format arrangement are disclosed in U.S. Pat. Nos. 4,672,760 and 4,790,094, both to Chesnut et al. In the '760 and '094 patents, the "banana" or arcuate shaped rear end wall of the magazine takes advantage of the curved stacking shape of the cartridges. The cartridges may also be stacked in a "nested" arrangement forming a double curving column of cartridges. Such curving is caused by the increased rim diameter as opposed to the casing diameter of each cartridge. Additionally, it is necessary to ensure that the rim of each cartridge is in front of the next cartridge rim directly below. Without this rim arrangement, jams occur when the uppermost cartridge is attempted to be loaded into the firearm chamber, as is well-known in the art. By nesting cartridges and curving the magazine, more cartridges may be loaded into a magazine than can be loaded into a non-curving single straight stack magazine. Still, it is a requirement of the arcuate shaped magazine that at least the uppermost cartridge be positioned at an angle relative to horizontal that approximately matches the magazine well/vertical angle of the firearm.

The banana clip may not require a thumb knob on the follower to assist in loading of the magazine. The forces generated between the cartridges and the magazine tend to be more rearward than forward, and thus the cartridges do not ride on both the front and rear end walls. Therefore, frictional forces are less in the banana clip magazine than in the vertical end wall magazine and loading is correspondingly easier. The banana clip style magazine, however, is not generally suited to a semi-automatic handgun that receives the magazine through the handgrip thereof, as a handgrip magazine well generally requires a magazine having vertical end walls which are straight and parallel to each other. Thus, there is a need for a magazine which takes advantage of the reduced frictional forces of a curved banana clip magazine and yet is adapted for insertion into the straight magazine well of a pistol.

SUMMARY OF THE INVENTION

The present invention disclosed herein comprises a magazine for use with a handgrip style magazine well which eliminates or greatly reduces problems associated with prior magazines. The present invention allows the loading of cartridges into a semi-automatic handgun with a magazine inserted into the handgrip thereof without excessive upfeed frictional forces between the cartridges and the magazine.

In accordance with one aspect of the invention, a magazine comprises a housing for retaining a plurality of cartridges. If the cartridges are of the rim-fire type, the cartridges are stacked to ensure that the rim of each cartridge is ahead of the rim of the cartridge directly below to prevent loading jams caused by the rim of the loading cartridge catching behind and/or on the cartridge rim therebelow. The housing comprises a storage zone, a transition zone and a loading zone. The magazine preferably comprises a synthetic material such as polycarbonate which is strong, lightweight and translucent.

The storage zone comprises generally vertical front and rear end walls with generally vertical sidewalls forming a first generally rectangular-shaped chamber. The external dimensions of the rectangular-shaped chamber approximately match the internal dimensions of a magazine well on a firearm. The transition zone, positioned between the storage zone and the loading zone, comprises the generally vertical front and rear end walls and gradually inwardly sloping sidewalls. The loading zone has the generally vertical front and rear end walls and generally vertical side walls (with additional loading assist devices attached thereto) forming a second chamber. The second chamber has internal dimensions which approximately match the external dimensions of one of the rim fire cartridges. A follower, loaded by a constant force spring, is provided to apply a loading force to the cartridge.

Proximate the loading zone is an open top end which is formed at an angle relative to horizontal which is approximately equal to a magazine well/vertical angle. The magazine well/vertical angle may be 20 which provides a convenient aiming angle for the firearm. A knob, attached through sidewalls of the housing to the follower, has an external surface approximately coplanar with an external surface of the storage zone. Upon reaching the transition zone of the housing, the knob gradually protrudes beyond the external surface of the sidewall for operative interconnection with a bolt lock-open device.

Rails are formed as protrusions extending inwardly from the internal surface of the sidewalls of the magazine. The rails are dimensioned to engage portions of the cartridges proximate the nose ends thereof while allowing the rim ends of the cartridges to separate. The engaging and separating of the cartridges arranges the cartridges into a "double-X" configuration in the storage zone that is both space efficient and relatively low in frictional forces.

As the cartridges enter the transition zone from the storage zone, a narrowing of the space between the sidewalls tends to bring the rim ends of the cartridges together, and the cartridges transition from the "double-X" configuration to a straight stack configuration in the loading zone. Thus, prior to being loaded into the chamber of the firearm, the cartridges assume the proper loading position which is generally parallel to a horizontal plane passing through the longitudinal axis of the firearm chamber.

A loading ramp is formed as a part of the external surface of the magazine proximate the open end thereof. The ramp serves as a guide for the nose of the cartridges to assist with insertion thereof into the chamber. Internal rim end ramps are also formed on opposite sides of the magazine within the loading zone. The rim ramps provide are angled surface for the cartridge rims to ride against just prior to insertion into the firearm chamber. The rim ramps serve to insure the cartridges are in a "nose-up" position (necessary to allow the cartridge nose to mate with the chamber entrance), to insure the rim of the uppermost cartridge stays ahead of the next lowermost cartridge and to begin placement of the cartridge nose on the nose loading ramp.

Nose pads are formed as inward protrusions from the sidewalls at the open end of the magazine to help retain the cartridges therein. The nose pads are dimensioned to form a gap therebetween slightly less than the diameter of the cartridges stored therein. In order to extract a cartridge from the magazine, the cartridge must deflect ("spring" apart) the nose pads apart sufficiently to widen the gap to allow a cartridge to pass therethrough.

It is a technical advantage of the present invention that a magazine is adapted for insertion into a firearm magazine well having a 20° well/vertical angle. The magazine is constructed to reduce frictional contact between the cartridges and the walls of the magazine which reduces the likelihood of upfeed problems.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION OF THE INVENTION

Figure 1:
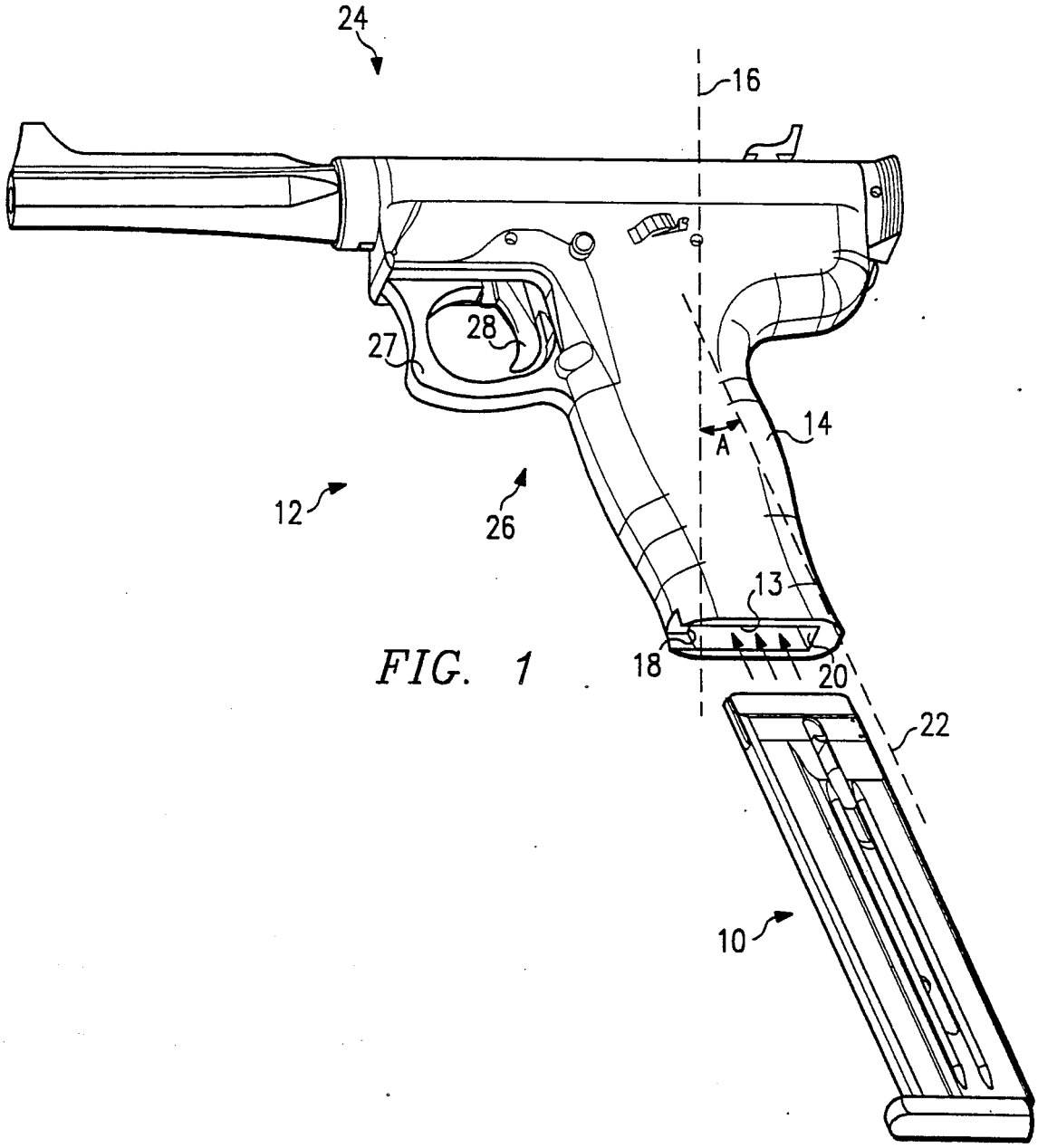
FIG. 1 is a perspective view of a magazine constructed in accordance with the present invention about to be inserted into the magazine well of a handgun.

Referring to FIG. 1, a perspective view of a magazine constructed in accordance with the preferred embodiment of the present invention about to be inserted into a handgun 12 is generally identified by the reference numeral 10. The handgun 12 may comprise a semi-automatic 0.22 caliber pistol such as is disclosed in copending U.S. application Ser. No. 436,369 filed Nov. 14, 1989, by the assignee herein, Ram-Line, Inc. of Golden, Colo., which is incorporated herein by reference. The handgun 12 is provided with a generally rectangular shaped magazine well 13 within a pistol grip 14.

An angle A, for example, a 20° angle, is formed between a vertical axis 16 and either a front end wall 18 or a rear end wall 20 of the magazine well 13 (end walls depicted by a line 22). There is a direct relationship between the angle A and the ease of aiming the handgun 12 at the end of an extended arm. If the angle A is 20°, it is subjectively easier or more natural to aim the handgun 12 than if the angle A were greater, for example, 30°, or less, for example, 15°. The magazine 10 is constructed and arranged to correspond to the angle A in order to correctly present a cartridge therein for loading into a chamber of the handgun 12, as will be subsequently described in greater detail.

The handgun 12 further comprises a bolt/barrel/-receiver group 24 which is matingly received by a grip assembly 26. The group 24 contains a chamber (See FIGS. 12*a–b*) for receiving a cartridge therein for firing, as is known in the art. The grip assembly 26 comprises the handgrip 14 and a trigger guard 27. A trigger 28, within the trigger guard 27, is interconnected to the group 24 in an appropriate manner to allow firing of the handgun 12.

Figure 2:
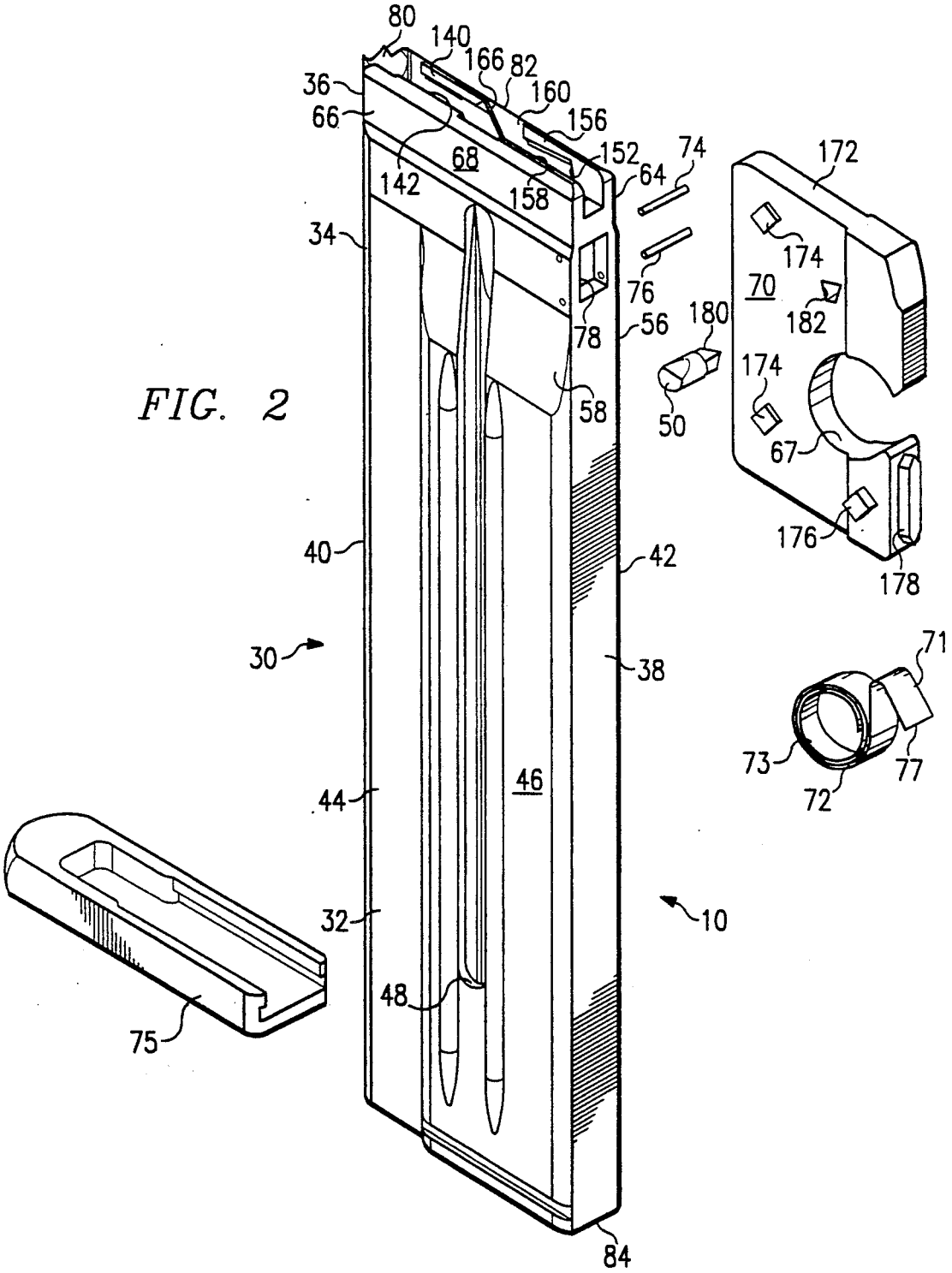
FIG. 2 is an exploded perspective view of the magazine of FIG. 1.

Referring to FIG. 2, an exploded perspective view of the magazine 10 of FIG. 1 is shown. The magazine 10 comprises a housing 30 for retaining a stack of a plurality of cartridges such as, for example, fifteen 0.22 caliber long rifle rim fire cartridges. The housing 30 comprises a storage zone 32, a transition zone 34 and a loading zone 36. The housing 30 may preferably comprise a one piece, translucent, polycarbonate shell. Alternatively, the housing 30 may comprise a plurality of sections bonded together.

The storage zone 32 comprises generally vertical rear and front end walls 38 and 40 and generally vertical sidewalls 42 and 44. The rear and front end walls 38 and 40 and the sidewalls 42 and 44, form a generally rectangular shaped chamber 46 which is externally dimensioned to approximately correspond to the internal dimensions of the magazine well 13 in the pistol grip 14 (see FIG. 1). The chamber is internally dimensioned to place cartridges therein in a first configuration, as will be subsequently described in greater detail. A slot 48 through the side wall 44 allows the passage of a knob 50, as will be subsequently described in greater detail.

The transition zone 34 is an integral continuation of the storage zone 32 and comprises the generally vertical rear and front end walls 38–40 and gradually inwardly sloping sidewalls 56 and 58. In the transition zone 34, cartridges transition from the first configuration to a second configuration in the loading zone 36, as will be subsequently described in g detail.

The loading zone 36 is an integral continuation of the transition zone 34 and comprises the generally vertical rear and front end walls 38 and 40 and generally vertical sidewalls 64 and 66, forming a second chamber 68. The second chamber 68 is internally dimensioned to approximately match the external dimensions of the of the cartridges placed therein.

Proximate an open end 82 of the loading zone 36 are cartridge assist devices comprising a loading ramp 80, nose pads 140 and 142, and internal rim end ramps 152 and 154 (only ramp 152 shown in FIG. 2). The loading ramp 80 helps guide a cartridge from the magazine 10 into the firearm chamber by serving as a bridge therebetween. The nose pads 140 and 142 extend inwardly from sidewalls 64 and 66 to reduce the spacing therebetween and thus help retain a cartridge the magazine 10.

The rim ramps 152 and 154 and extension lips 156 and 158 therefrom also serve important cartridge guiding and retaining functions within the magazine 10. The rim ramps are formed at an angle relative to vertical, as will be subsequently described in greater detail, to properly position each cartridge prior to extraction thereof from the magazine 10.

The extension lips 156 and 158 help retain and guide the cartridge rims within the magazine 10 until the cartridge rim reaches a gap 160 between the extension lips 156 and 158 and the nose pads 140 and 142. Upon reaching the gap 160, the cartridge rim is able to pass through the open end 82 and the cartridge may thus be inserted into a firearm chamber (or be loaded into the magazine 10). Thus, the combination of the loading ramp 80, the nose pads 140 and 142 and the rim ramps 152 and 154 result in a cartridge being properly positioned for insertion into a firearm chamber.

A follower 70 is installed within the magazine 10 for supporting cartridges therein and for transferring a loading force thereto. The follower 70 has top surface 172, formed at an angle relative to horizontal generally equal to the angle A (see FIG. 1), which supports and guides the cartridges within the magazine 10. A plurality of diamond-shaped protrusions 174 are formed on a forward portion of the follower 70, and at least one diamond shaped protrusion 176 is formed on a rearward portion of the follower 70. The protrusions 174 and 176 extend sufficiently from the follower 70 to allow a sliding engagement therebetween and the internal surfaces of the magazine 10. A double wedge shaped protrusion 178 extends from the follower 70 for engagement with the internal surface of the rear end wall 38 of the magazine 10. The protrusions 174, 176 and 178 are shaped to push extraneous material (such as dirt and sludge) out of the way regardless of the direction of travel of the follower 70. Although not shown, it is to be understood that the protrusions 174, 176 and 178 may be any other appropriate shape such as rectangular, circular, etc., so long as debris is pushed aside thereby.

A spring 72, such as a constant force (hereinafter conforce) spring, is attached to the magazine 10 by a first prebent end 71 (having a tip end 77 and positioned within a recess 67 in the follower 70 by a second end 73. Pins 74 and 76 and window 78 are provided for proper installation of the spring 72 to the housing 30. Alternatively, one pin 74 may be used in conjunction with a portion of the magazine (not shown) instead of the second pin 76. Although the spring 72 is shown as being installed only against the rear end wall 38 of the magazine 10, it is to be understood that the spring 72 could be installed only against the front end wall 40 (not shown) could be installed with one against the rear end wall 38 and one against the front end wall 40.

The knob 50 is shaped to ride in the slot 48 of the magazine 10 and to actuate a rotary bolt open mechanism after the last cartridge has been fired. The knob 50 is received by an insertion end 180 within a hole 182 in the follower 70 which matches the shape thereof. A bottom "butt" plate 75 is slidably attached to the housing 30 at a bottom end 84 to enclose the magazine 10, as is known in the art.

Figure 3A:
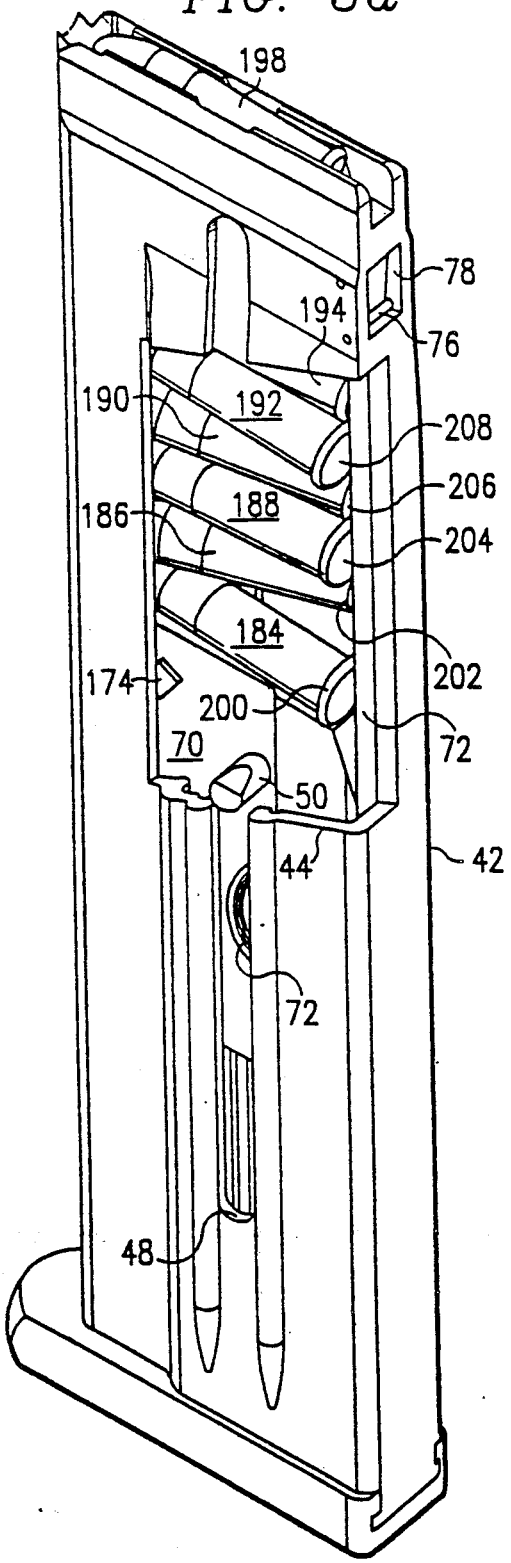
FIGS. 3*a–b* are perspective views of the magazine of FIG. 2 with a partial cut-out showing the arrangement of cartridges therein.
Figure 3B:
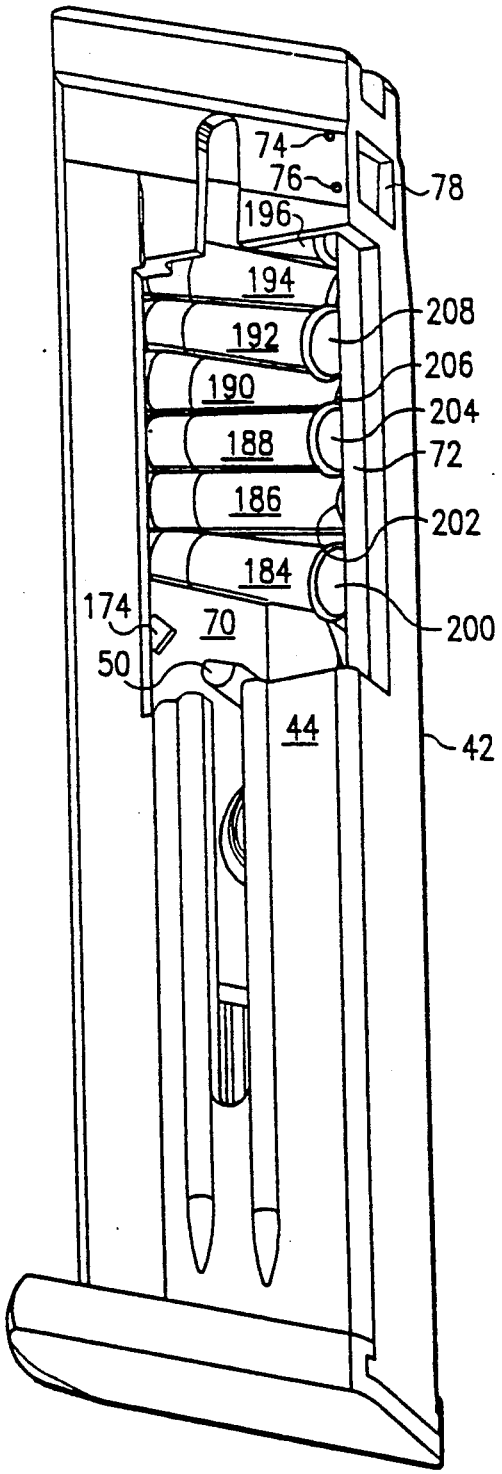

Referring simultaneously to FIGS. 3*a–b*, perspective views of the magazine of FIG. 2 are shown fully assembled, partially loaded and with a partial cut-out through sidewalls 44 and 58. Cartridges 184, 186, 188, 190 and 192 are arranged within the storage zone 32 in the first configuration comprising a double-X or a criss-crossed pattern. Cartridges 194 and 196 (and part of cartridge 192) are in the transition zone 34 while cartridge 198 is in the open end 82. As used herein, double-X is defined as a single stack cartridge configuration in which cartridges are crossed over each other by engaging portions of the cartridges proximate the nose ends while allowing the rim ends to move outwardly against the magazine sidewalls. The double-X configuration is a single stack because the cartridges are placed one over the other, yet is modified over the prior art by spreading the rim ends. It should also be noted that dimensions given herein are examples only and are approximate for 0.22 cal. long rifle cartridges Any sample dimensions given have a ±5% tolerance and, obviously, will vary for other types of cartridges.

The double-X pattern allows the rim ends 200 202, 204, 206 and 208 of the cartridges 184, 186, 189, 190 and 192, respectively, to separate due to the spacing between the side walls 42 and 44, as will be subsequently described in greater detail. It is believed, based upon observation, that the double-X pattern also generates forces on the cartridges in the magazine 10 either forward against the front end wall 40 and off the rear end wall 38 or rearward against the rear end wall 38 and off the front end wall 40, depending upon whether the magazine 10 is being loaded or unloaded. Due to the geometric relationships between the magazine 10 and the cartridges, cartridges are forced forward against the front wall 40 during loading of the magazine 10 and rearward against the rear end wall 38 during unloading of the magazine 10. By keeping the cartridges off the rear end wall 38 or the front end wall 40, frictional forces are greatly reduced therebetween allowing for a smoother loading and a smoother unloading of the magazine 10. Therefore, in contrast to the magazine disclosed in U.S. Pat. No. 4,509,283 to Chesnut et al., there is no requirement to extend the knob 50 through the sidewalls of the magazine 10 to provide a thumb assist for counteracting the conforce spring 72 during loading of the magazine 10.

Figure 4A:
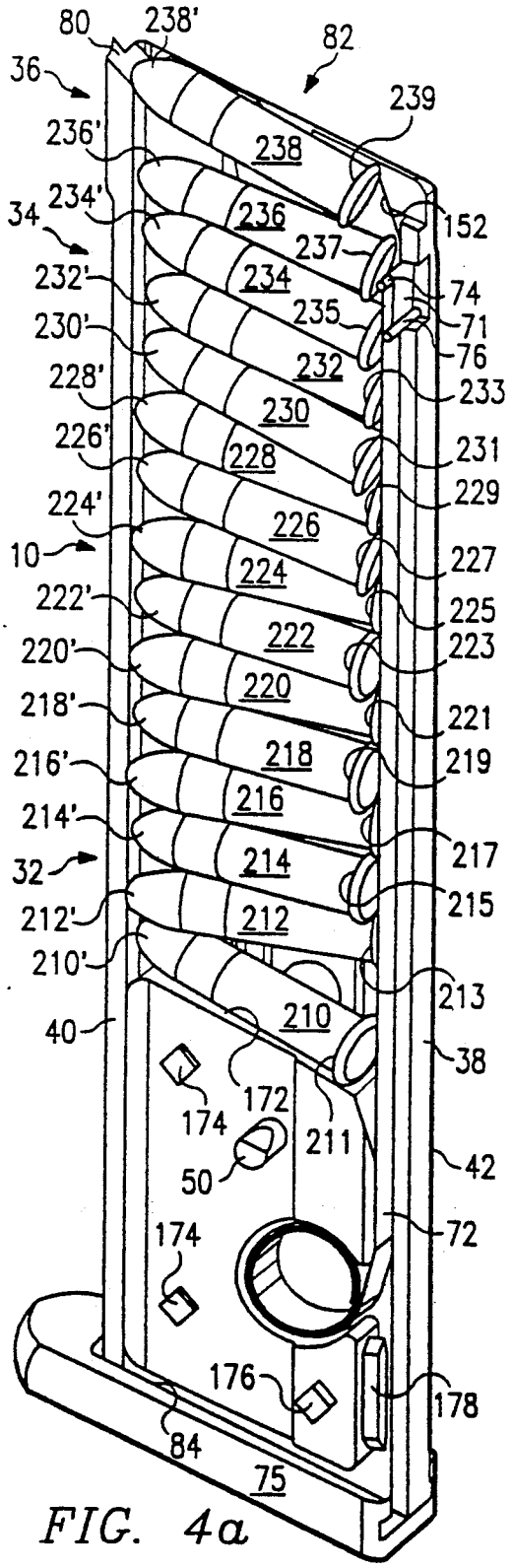
FIGS. 4*a–b* are views of the magazine of FIG. 3 with the sidewalls removed.
Figure 4B:
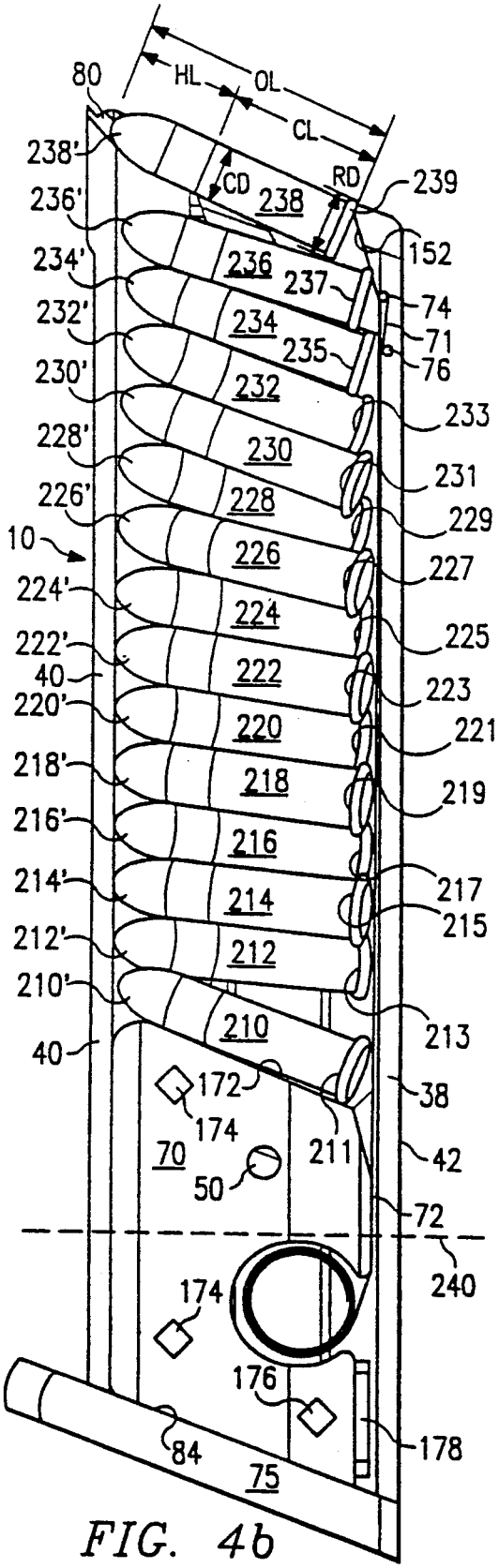

Referring simultaneously to FIGS. 4*a–b*, 5*a–b* and 6*a–b*, views of the fully loaded magazine 10 with the sidewalls 44, 58 and 66, front end wall 40 and rear end wall 38, respectively, removed therefrom are shown In FIGS. 4*a–b*, 5*a–b* and 6*a–b*, fifteen 0.22 cal. long rifle cartridges 210, 212, 214, 216, 218, 220, 222, 224, 226, 228, 230, 232, 234, 236 and 238 are loaded into the magazine 10. For the sake of example, cartridges 210, 212, 214, 216, 218, 220, 222, 224, 226 and 228 are considered to be in the storage zone 32, cartridges 230, 232 and 234 are considered to be in the transition zone 34 and cartridges 236 and 238 are considered to be in the loading zone 36. As can be seen, the cartridges are placed in the double-X or criss-crossed pattern in the storage zone 32. Referring to FIG. 4*b*, these cartridges have the following approximate dimensions: casing length CL=0.590 inch; projectile (nose) length HL=0.400 inch; overall length OL=0.990 inch; casing diameter CD=0.224 inch; and rim end diameter RD=0.275 inch.

Figure 5A:
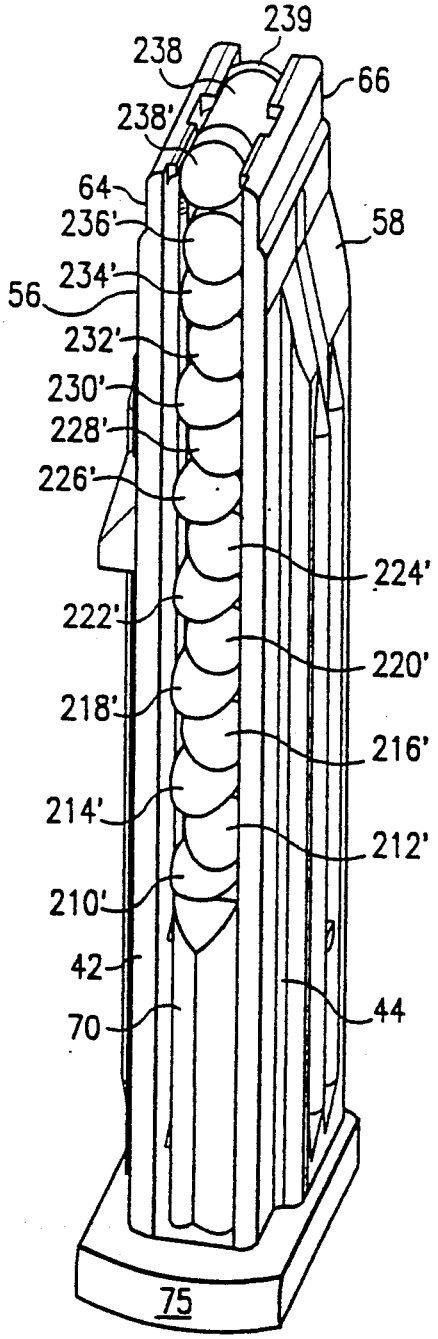
FIGS. 5*a–b* are views of the magazine of FIG. 3 with the front end wall removed.
Figure 5B:
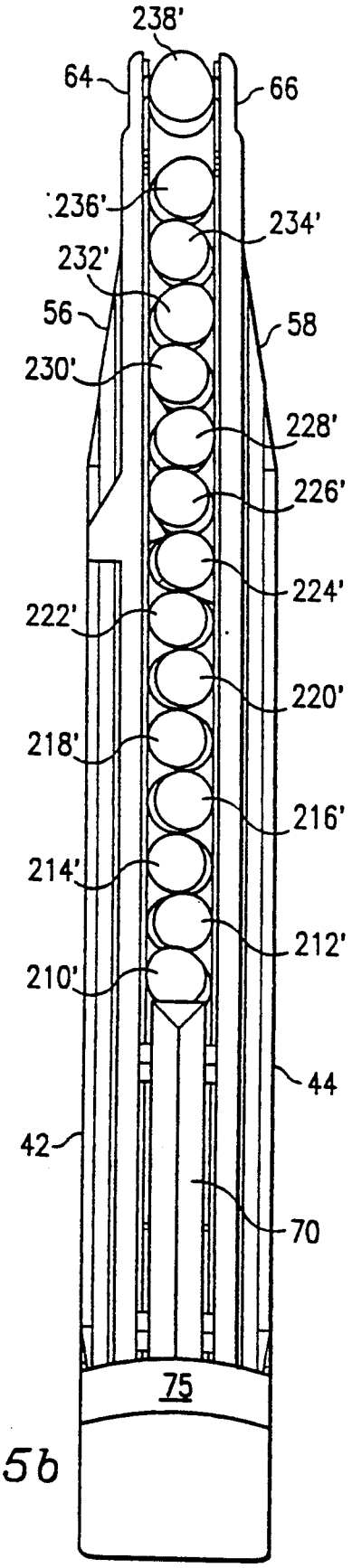
Figure 6A:
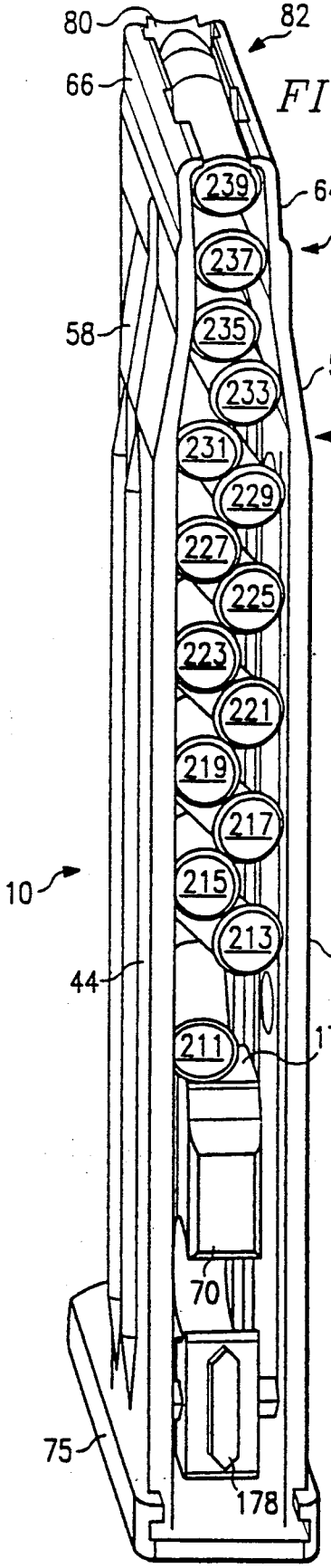
FIGS. 6*a–b* are views of the magazine of FIG. 3 with the rear end wall removed.
Figure 6B:
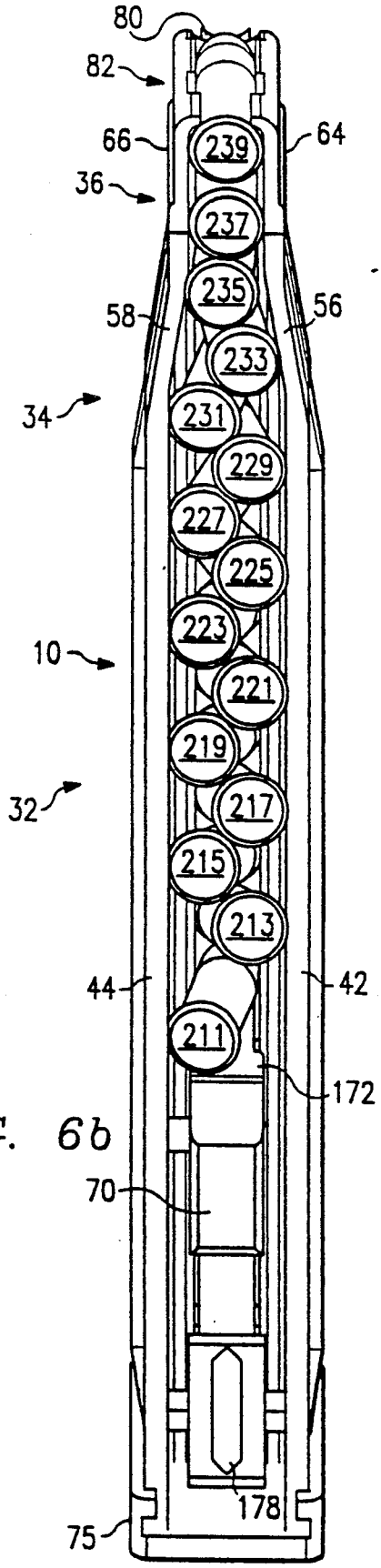

Due to the geometry of the transition zone 34, as the first cartridge 210 is loaded into the storage zone 32 of the magazine 10, the rim end 211 thereof will tend to move toward the bottom end 84 and toward either the sidewall 42 or the sidewall 44 while resting on the top surface 172 of the follower 70. The rim end 213 of the next cartridge 212 will also move toward the bottom end 84 and toward the opposite sidewall 42 or 44 from the cartridge 210 (as shown in FIGS. 4–6, the rim end 211 of cartridge 210 is against sidewall 44 and the rim end 213 of the cartridge 212 is against the sidewall 42). Subsequent cartridges 214, 216, 218, 220, 222, 224, 226 and 228 alternate, due to the geometry of the transition zone 34, from side 42 to side 44 (see FIGS. 6*a–b*) throughout the storage zone 32. As the rim ends 211, 213, 215, 217, 219, 221, 223, 225, 227 and 229 go toward sidewall 42 or 44, the nose ends 210', 212', 214', 216', 218', 220', 222', 222', 224', 226' and 228' of each cartridge 210, 212, 214, 216, 218, 220, 222, 224, 226 and 228 go toward the opposite sidewall. For example, as the rim end 211 of the cartridge 210 goes toward the sidewall 44, the nose end 210' goes toward the sidewall 42. Thus, the nose ends 210', 212', 214', 216'216', 220', 222', 224', 226' and 228' alternate from side 42 to side 44 (see FIGS. 5*a–b*) and the cartridges 210, 212, 214, 216, 218, 220, 222, 224, 226 and 228 are arranged in the double-X configuration in the storage zone 32.

The same alternating pattern of the storage zone 32 is maintained (or started depending upon whether the magazine is being loaded or unloaded) in the transition zone 34 although the pattern becomes progressively straighter due to the sloping sidewalls 56 and 58 (see FIGS. 5*a–b* and 6*a–b*). Within the loading zone 36, the cartridges 236 and 238 are arranged in the second or straight stack configuration prior to being loaded into a firearm chamber.

Referring to FIG. 4*b*, it can be seen that the cartridges 210 and 238 are both oriented at an angle, with reference to a horizontal line 240, approximately equal to the angle A (see FIG. 1)(cartridge 238 may actually be at a slightly greater angle, for example, 25°). However, the remaining cartridges 212, 214, 216, 218, 220, 222, 224, 226, 228, 230, 232, 234 and 236 are oriented at some other angle less than the angle A, due to the geometry of the magazine 10. As the cartridges 212, 214, 216, 218, 220, 222, 224, 226, 28, 230, 232, 234 and 236 approach the open end 82 of the magazine 10, the angle of their orientation becomes closer to the angle A. Upon striking the rim ramps 152 and 154 (only ramp 152 shown in FIGS. 4*a–b*), the rim end of each cartridge is pushed toward the front end wall 40 which causes the nose ends to engage the front end wall 40. Obviously the cartridges cannot escape the front end wall 40, therefore, the nose ends slide upward on the wall 40 and the cartridge approaches the 20° angle orientation as it moves upward in the loading zone 36.

Additionally, referring to FIGS. 4*a–b*, it can be seen that the cartridges 210, 212, 214, 216, 218, 220, 222, 224, 226, 228, 230, 232, 234, 236 and 238 either contact each other at one point only (or at a line contact). The contact between each cartridge varies throughout the magazine 10 but is generally proximate the nose ends 210', 212', 214', 216', 218', 220', 222', 224', 226', 228', 230', 232', 234' and 236'. Only the cartridges 236 and 238 contact each other at some point distal their nose ends 236' and 238'. The rim end 239 of the cartridge 238 contacts the cartridge 236 along the casing thereof proximate the rim end 237 due to the action of the rim ramp 152 (and 154).

The cartridges 210, 212, 214, 216, 218, 220, 222, 224, 226, 228, 230, 232, 234, 236 and 238 are generally positioned with their rim ends 211, 213, 215, 217, 219, 221, 223, 225, 227, 229, 231, 233, 235, 237 and 239, respectively, against the rear end wall 38 (actually the spring 72 in the example shown) and off the front end wall 40. The rim ends of each cartridge 210, 212, 214, 216, 218, 220, 222, 224, 226, 228, 230, 232, 234, 236 and 238 is also positioned ahead of the rim end of the cartridge directly below. The rim ramps 152 and 154 ensure that the rim ends of the cartridges in the loading zone 36 are so arranged, and therefore, jams will not occur as a result of the rim end of the cartridge being loaded into a firearm chamber catching on the rim end of the cartridge therebelow.

Figure 13B:
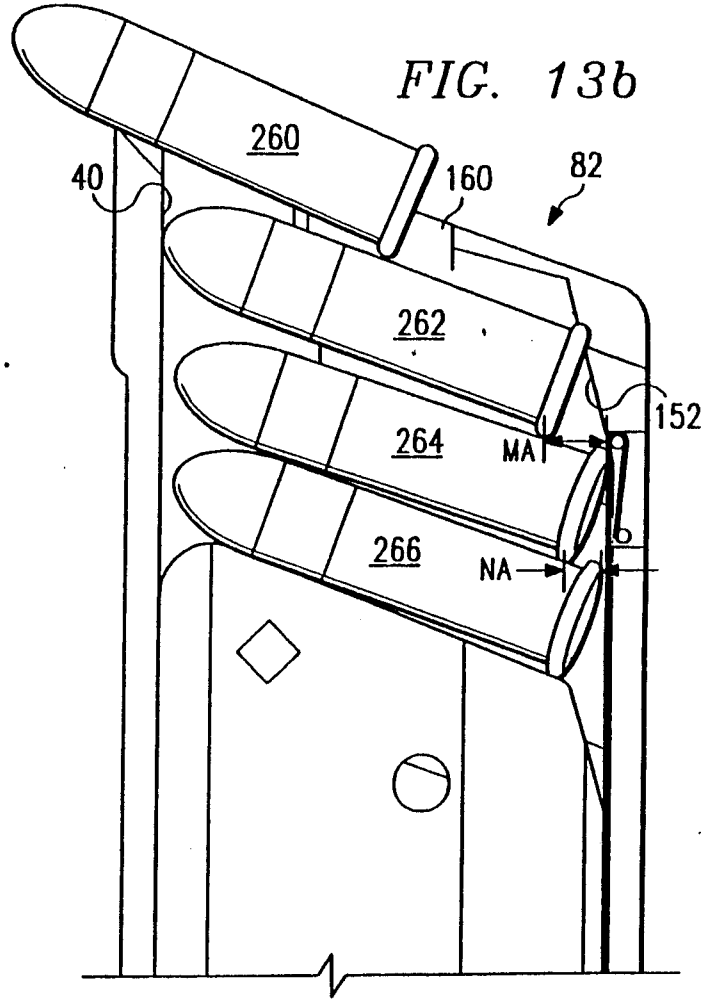
FIGS. 13*a–b* are partial cross-sectional views of the present invention illustrating the torquing forces on cartridges.
Figure 13A:
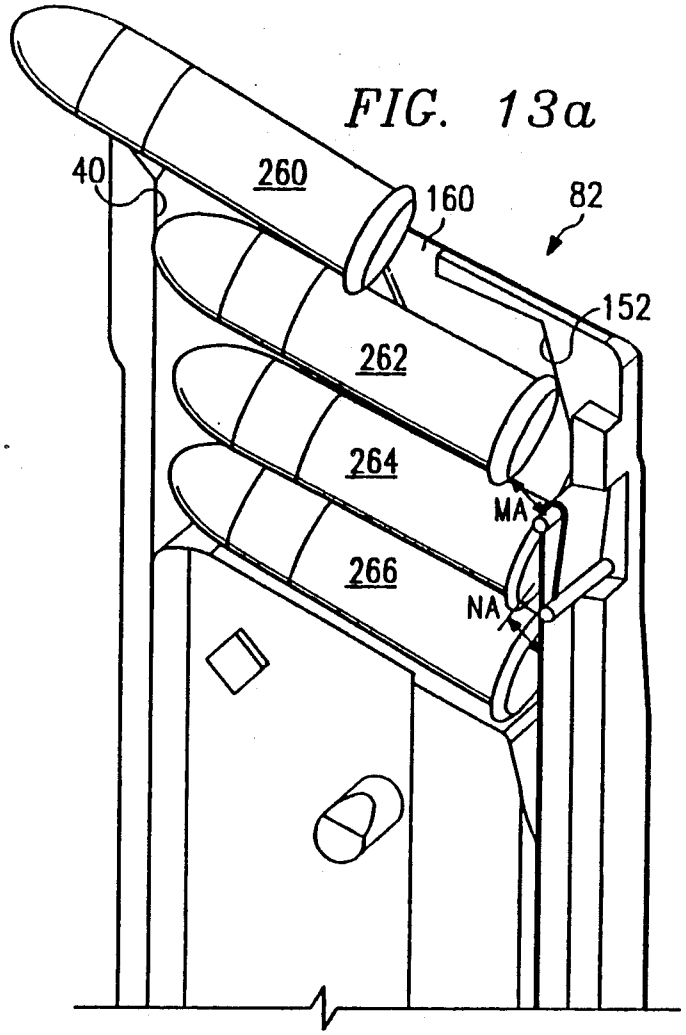

Referring to FIGS. 13*a* and 13*b*, partial side views of the magazine 10 are shown with a cartridge 260 in the process of being removed therefrom. As the cartridge 260 leaves the magazine 10, a next lower cartridge 262 moves both upward and forward toward the open end 82, i.e., the ramp 152 pushes the cartridge 262 against the front wall 40 while the follower 70 continues to push the cartridge 262 upward. Due to the ramp 152 pushing the cartridge 262 toward the wall 40, a moment arm MA is formed between a cartridge 264 and the cartridge 262 between points where the cartridge 264 contacts the spring 72 and the cartridge 262. Moment arm MA is greater than a moment arm NA between the cartridge 264 and a cartridge 266. Therefore, a torquing force is applied to the cartridge 262 which (in conjunction with the ramp 152 and the front end wall 40) tends to move the cartridge 262 into the "nose up" loading position as previously shown by the cartridge 238 in FIGS. 4–6.

Figure 7:
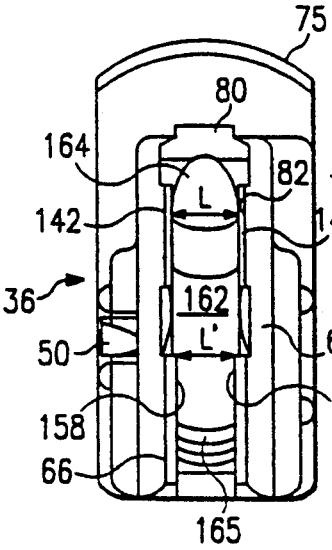
FIG. 7 is a top plan view of the magazine of FIG. 3.

Referring to FIG. 7, a top plan view of the magazine 10 is shown. A cartridge 162 is positioned in the loading zone 36 in the open end 82 thereof. The cartridge 162 is in a "nose up" condition with a nose end 164 thereof already placed partially on the ramp 80 and positioned to be loaded into the chamber of a firearm. The nose pads 140 and 142, spaced apart a distance L, and the rim ramp extension lips 156 and 158, spaced apart a distance L', on the sides 64 and 66, respectively, of the loading zone 36 help retain the cartridge 162 within the magazine 10. The extension lips 156 and 158 also retain the cartridge 162 by rim end 165 which is diametrically larger than the spacing L' therebetween. A bolt face (see FIGS. 12*a–b*) or other appropriate loading device strips the cartridge 162 from the open end 82 for loading into the firearm chamber, as is known in the art.

Figure 8:
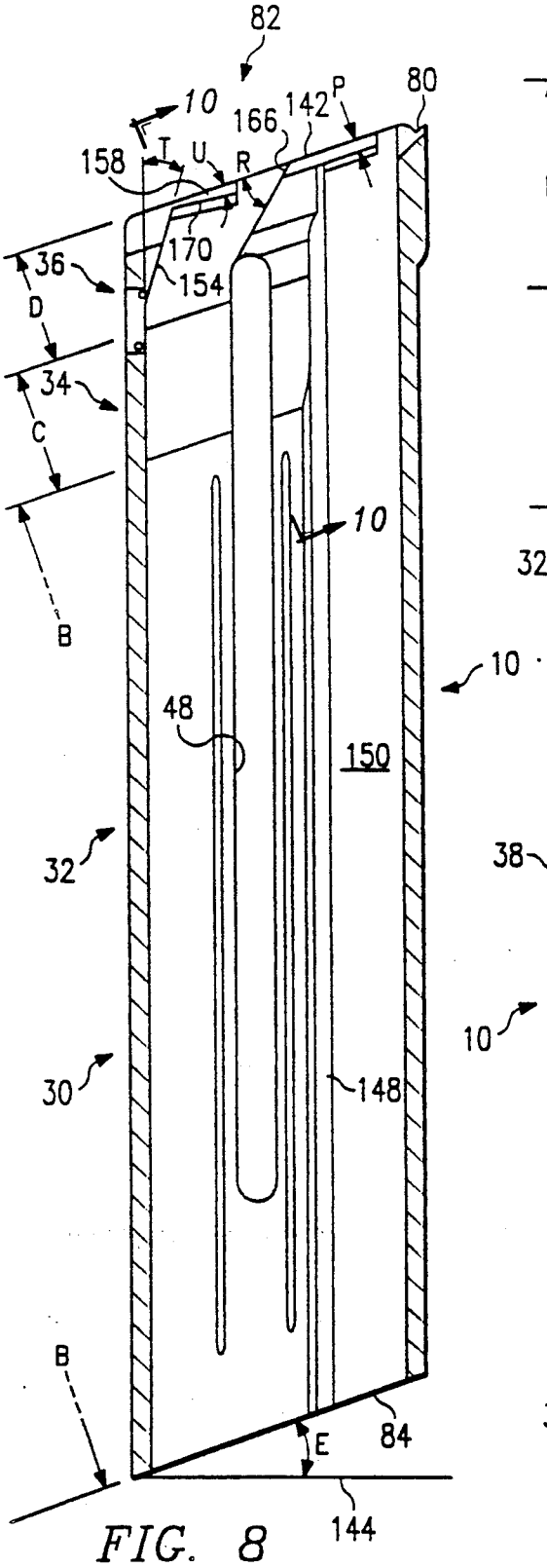
FIG. 8 is a longitudinal cross-sectional view of the magazine constructed in accordance with the present invention.

Referring to FIG. 8, a cross-sectional view of the magazine 10 is shown. The storage zone 32 has a length B (shown as a distance along a broken line due to physical constraints of the drawing sheet) which depends upon the number of cartridges to be stored therein. The transition zone 34 has a length C, for example, 0.510 inch, which is sufficient to allow approximately 3–4 cartridges to transition progressively from the double-X pattern to a straight stack pattern. The loading zone 36 has a length D, for example, 0.470 inch, sufficient to allow approximately 2–3 cartridges to be held therein in a single but straight stack (the second configuration) prior to being chambered into a firearm.

The open end 82 and the bottom end 84 are formed at an angle E relative to a horizontal line 144. The angle E is approximately equal to the Angle A (see FIG. 1) which reflects the angular relationship between the handgrip 14 and the vertical axis 16.

Rails 146 and 148 (see FIG. 9) protrude from an internal surface 150 of the housing 30. The rails 146 and 148 provide guides for cartridges within the housing 30 and help position cartridges in the double-X configuration. In the example of 0.22 cal. long rifle cartridges, the rails 146 and 148 protrude a distance F of 0.105 inch from the internal surfaces 150 and thus form a gap G therebetween of 0.235 inch versus the gap H of 0.445 inch between the internal surfaces 150 on opposite sidewalls 42 and 44 (see FIG. 9). Since a 0.22 cal. long rifle cartridge is approximately 0.224 inch in diameter along the casing and approximately 0.275 inch in diameter at the rim end, it is apparent that there is some amount of extra room in the magazine 10. The relatively narrow gap G between the rails 146 and 148 allows the rails 146 and 148 to engage portions of the cartridges proximate the nose ends thereof while allowing the rim ends to spread apart into the expanded gap H between the sidewalls 42 and 44, thus forming the double-X configuration. The rails 146 and 148 are formed a distance J of approximately 0.700 inch from the rear end wall 38 and thus contact cartridges along the nose ends thereof.

Figure 9:
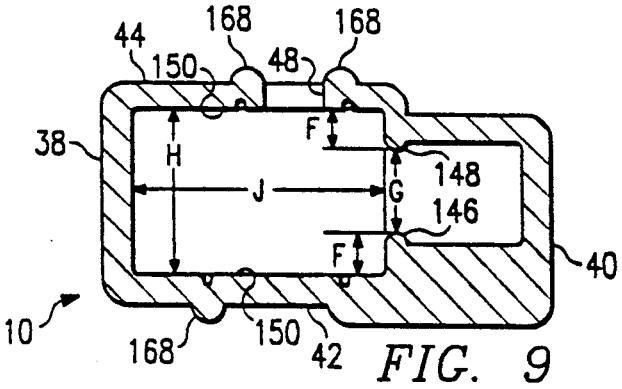
FIG. 9 is a cross-sectional view along the line 9—9 of FIG. 2.

Also shown in FIG. 9 are external ribs 168 which protrude from the sides 42 and 44 of the magazine 10. The ribs 168 help provide intimate contact with the internal surfaces of the magazine well 13 (see FIG. 1). Thus, if the internal dimensions of the magazine well 13 are such that the external dimensions of the housing 30 do not match therewith, the ribs 168 compensate therefor. Thus, it is possible to adjust the magazine 10 to fit various magazine well dimensions without having to increase the thickness of the walls thereof. Additionally, the ribs 168 prevent access to the knob 50 (see FIG. 2) by the thumb or finger of an operator, as no such access is necessary.

Figure 10:
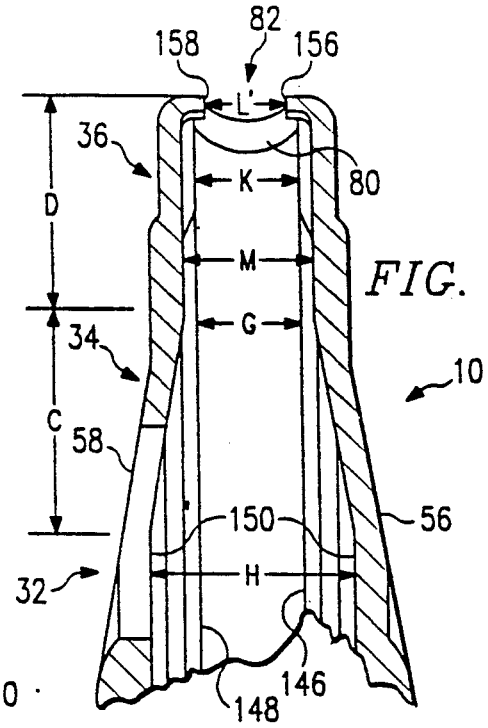
FIG. 10 is a partial cross-sectional view taken generally along the lines 10—10 of FIG. 8.

Referring to FIG. 10, a partial cross-sectional view of both sidewalls along the line 10—10 of FIG. 8 is shown. The rails 146 and 148 are spaced the gap G from each other throughout the storage zone 32 and the transition zone 34. Proximate the open end 82, however, the distance therebetween becomes slightly less as indicated by a gap K of approximately 0.230 inch. At the open end 82, the nose pads 140 and 142 are spaced apart the distance L of approximately 0.210–0.215 inch (see FIG. 7). Thus it can be appreciated that the nose pads 140 and 142 must be flexed apart like a spring by the cartridges (having 0.224 inch diameters) in order to pass therethrough. The extension lips 156 and 158 are spaced apart the distance L' which may be approximately 0.180–0.190 inch, and, therefore, the rim end of a cartridge can only pass through the gap 160 (see FIG. 2). Due to the geometry of the magazine 10 and the dynamics thereof on cartridges therein, the rim ends of the cartridges may "pop up" through the gap 160 immediately after passing the extension lip 156, may ride up through the gap 160 along a slanted surface 166 or pass through the gap 160 somewhere therebetween.

The transition zone 34 and the loading zone 36 are more clearly shown in FIG. 10. The transition zone 34 has sloping sidewalls 56 and 58 which change the distance between the internal surfaces 150 from the gap H, which may be 0.445 inch in the storage zone 32, to a gap M, which may be 0.280 inch, in the loading zone 36. Additionally, the length D and the length C of the loading zone 36 and the transition zone 34 are indicated.

Referring again to FIG. 8, the nose pads 140 and 142 and rim ramps 152 and 154 (only nose pad 142 and rim ramp 154 shown) provide retention of and guides for cartridges. The nose pad 142 is formed in conjunction with the slanted rear surface 166 and has a thickness P. The slanted surface 166 is at an angle R which may be approximately 45° and the thickness P may be approximately 0.050 inch.

The rim end ramps 152 and 154 and their extension lips 156 and 158 (only ramp 154 and extension lip 158 shown in FIG. 8) are also important to the proper functioning of the magazine 10. The rim ramp 154 is formed at an angle T which may be approximately 15°. The extension lip 158 has a lower surface 170 formed at an angle U which may be approximately 5°. As a cartridge enters the loading zone 36, the rim end thereof begins to contact the rim ramp 154 (and ramp 152). The ramp 154 exerts a force on the cartridge rim end which tends to hold the rim end down and pushes the nose end forward while the loading force from the conforce spring 72 (see FIG. 2) continues to push the nose end of the cartridge up. Thus, the combination of forces will tend to place the cartridge in a "nose up" condition as the cartridge approaches the open end 82. As the cartridge reaches the open end 82 prior to being loaded into a chamber, the cartridge should be at an approximate 25° angle with the nose end thereof slightly onto the loading ramp 80, due to the rim ramp 154. Thus, the rim ramp 154 serves to provide "nose up" force, to begin placement of the cartridge nose onto the loading ramp 80, and to keep the rim end of the uppermost cartridge ahead of the rim end of the next lower cartridge. As a result of the dynamics of the magazine 10, the ramp 154 causes the cartridges to slide forward onto the ramp 80 and also causes upward rotation of the nose end of the cartridges due to an increase in torque through the increase in moment arms from moment arm NA to moment arm MA (see FIGS. 13*a–b*). As previously indicated above, the extension 158 (and extension 156) in conjunction with the nose pads 140 and 142 help retain a cartridge within the loading zone 36 until purposefully removed therefrom.

In operation, a plurality of, for example, fifteen, 0.22 cal. long rifle cartridges are inserted into the magazine 10. As the cartridges are inserted therein, each cartridge is positioned with its rim end within the gap 160 while sufficient pressure is applied to move the cartridge past the nose pads 140 and 142 and into the loading zone 36. As subsequent cartridges are inserted, the rim ramps 152 and 154 ensure that the rim end of each new cartridge is always in front of the rim end of the next cartridge therebelow.

Within the loading zone 36, the cartridges are in a single straight stack configuration. As the cartridges begin to enter the transition zone, the rails 146 and 148 begin to force the rim end of each cartridge alternatively toward either the sidewall 56 or the sidewall 58. As the cartridges enter the storage zone 32, they are arranged in the double-X configuration (modified single stack) with the nose ends thereof held between the rails 146 and 148 and with the rim ends thereof against either the sidewall 42 or the sidewall 44 in an alternating pattern.

As previously described above, the nose ends of the cartridge may engage the front end wall 40 with the rim ends off the rear end wall 38 during loading of the magazine 10. Thus, the nose ends will tend to slide easily downward within the magazine 10 without any opposing force from the rim ends contacting the rear end wall 38.

Once the magazine 10 is placed within the magazine well 13 of the firearm 12, the cartridges may be rapidly unloaded therefrom. The uppermost cartridge in the open end 82 of the loading zone 36 is positioned "nose up" at an approximately 25° angle and with a nose end partially on the loading ramp 80 ready to be removed from the magazine 10 by a bolt face and loaded into the chamber. The next lower cartridge is then forced toward the open end 82 by the conforce spring 72 and the follower 70. At the same time, contact with the rim end ramps 152-154 causes the cartridge to move forward toward front end wall 40 and upward into the same loading position just vacated.

As the cartridges move from the storage zone 32 to the loading zone 36, they are gradually transitioned from the double-X configuration to the straight stack configuration by the sloping sidewalls 56 and 58 of the transition zone 34. Due to the geometry of the magazine 10, the cartridges therein are pushed away from the front end wall 40 during the sequence of unloading cartridges from the magazine 10. Only the cartridge in the loading zone 36 will contact the front end wall 40 which acts as a cam to help slide the nose ends upward. Thus, there are reduced frictional forces between the cartridges and the magazine 10 during loading and unloading thereof and no loading assistance is required from the knob 50 which serves only to lock the bolt in an open position upon unloading the last cartridge (and to prevent the follower 70 from escaping the housing 30).

Figure 11A:
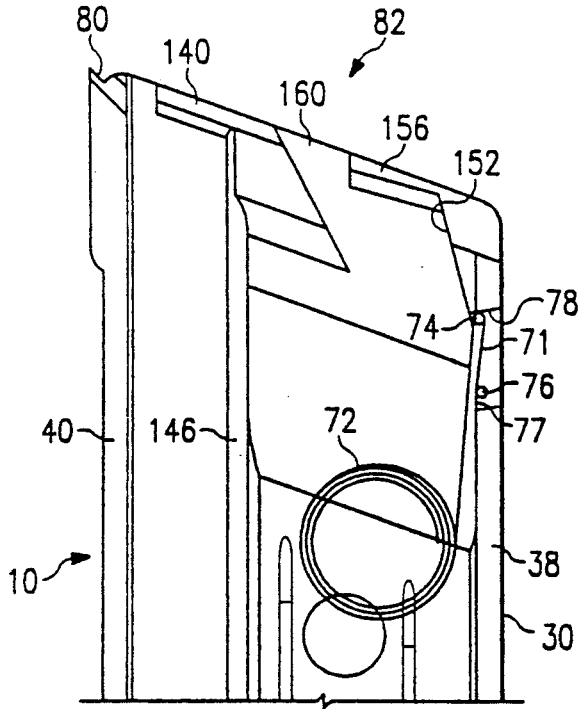
FIGS. 11*a–b* are partial cross-sectional and perspective views, respectively, showing detail of the spring connection to the magazine in accordance with the preferred embodiment of the present invention.
Figure 11B:
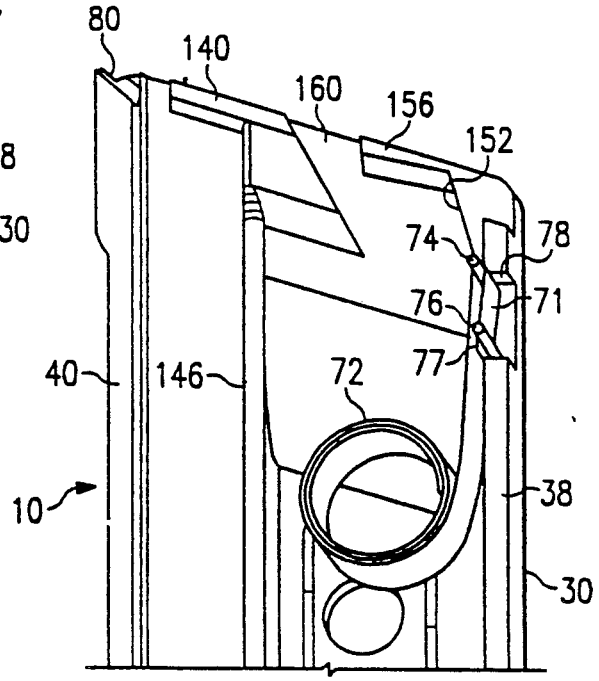
Figure 11C:
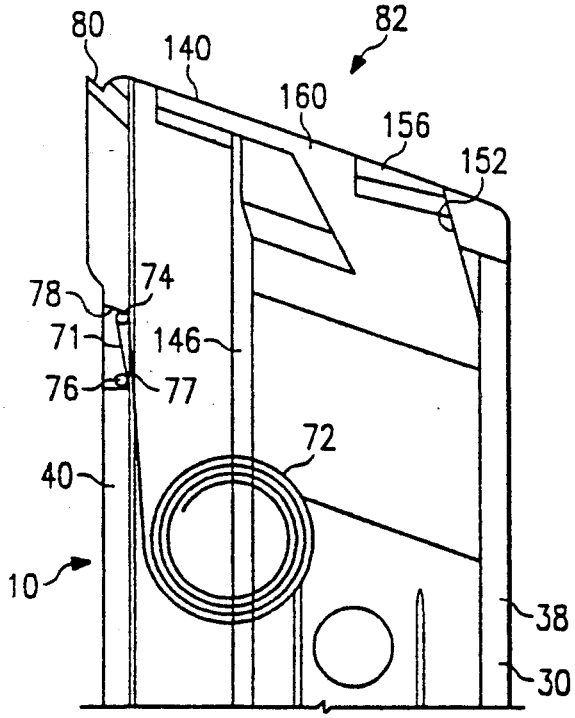
FIG. 11*c* is a partial cross-sectional view showing detail of the spring connection to the magazine in accordance with an alternative embodiment of the invention.

Referring simultaneously to FIGS. 11*a* and 11*b*, the relationship between the conforce spring 72 and the magazine 10 is shown in more detail. The sidewalls 44, 58 and 64 and the follower 70 have been removed for the sake of clarity. The spring 72 is formed with the first end 71 prebent (see FIG. 2). The first end 71 is placed around the pin 74 and then the tip end 77 is bent toward, over and behind the pin 76 (or body part, not shown) which secures the tip end 77 therein. The window 78 allows the attachment of the spring 72 to a one piece housing 30 by providing the required access to the first end 71 and the pins 74 and 76 and clearance for the tip end 77. The pin 74 is positioned (as shown in FIGS. 11*a* and 11*b*) above and to the left of the pin 76. As the spring 72 is unwound by inserting cartridges into the magazine 10, the spring 72 extends into the housing 30 from the pin 74 past the pin 76. Since the pin 76 is positioned farther right than the pin 74, the unwound portion of the spring 72 is not displaced by the pin 76 or the tip end 77. Thus, the cartridges are not forced away from their natural path within the magazine 10 by any "bumps" or protrusions in the spring 72, and smoother loading and unloading of the magazine 10 is possible.

Figure 12A:
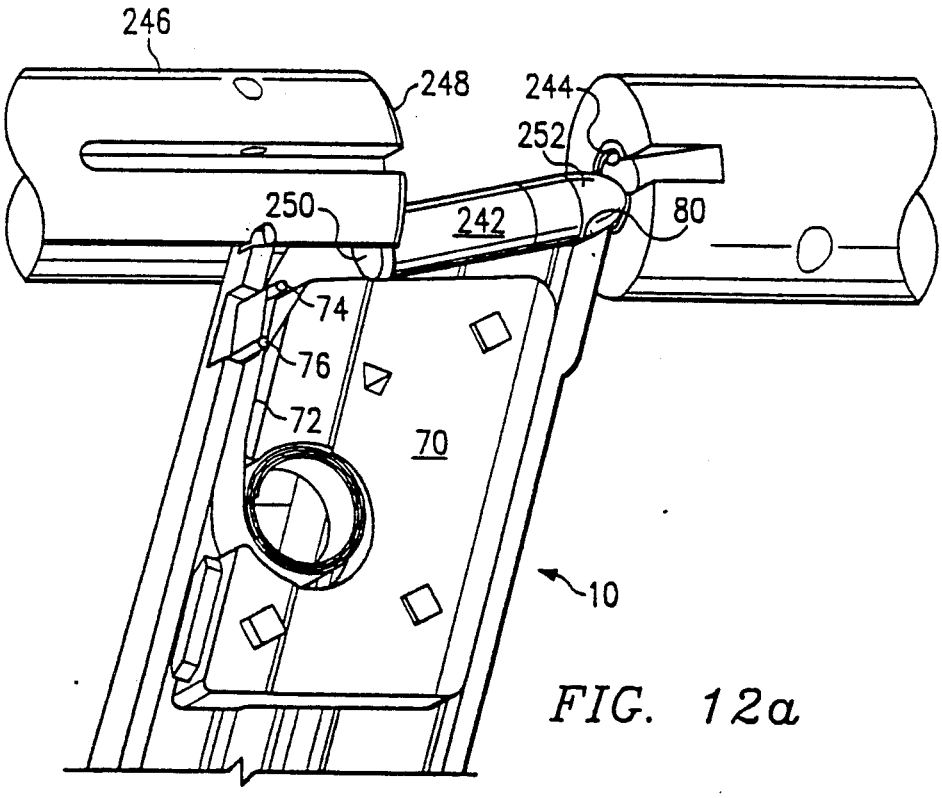
FIGS. 12*a–b* are partial cross-sectional views of the magazine of the present invention with a cartridge being loaded into the chamber of a firearm.
Figure 12B:
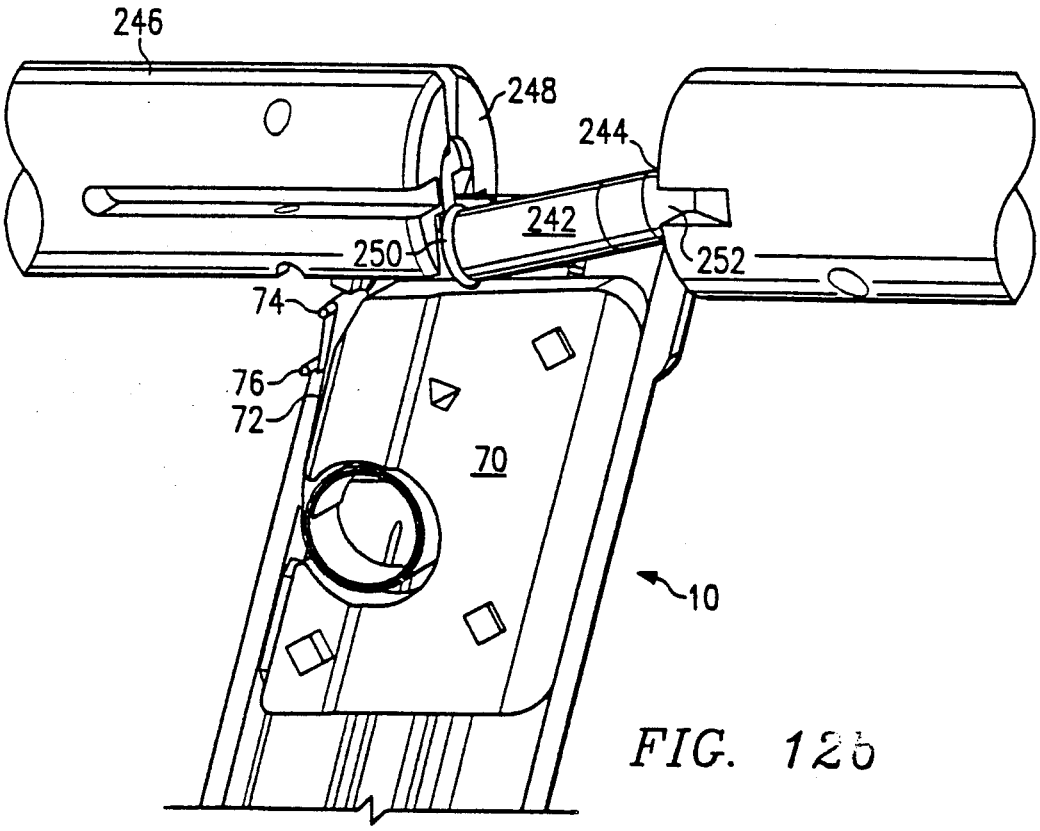

Referring simultaneously to FIGS. 12*a* and 1*b*, perspective views are shown of the loading of a cartridge 242 into a chamber 244 of a firearm. A bolt 246 having a bolt face 248 contacts a rim end 250 of the cartridge 242 in the open end 82 of the magazine 10. A nose end 252 of the cartridge 242 rests on the rim ramp 80 which spans a gap between the magazine 10 and the chamber 244. The cartridge 242 slides within the open end 82 of the magazine 10 until the rim end 250 reaches the gap 160 (see FIG. 2). The rim end 250 then passes through the gap 160 and the bolt 246 loads the cartridge 242 into the chamber 244.

Although the present invention has been described with respect to a specific preferred embodiment thereof, various changes and modifications may be suggested to one skilled in the art. It is intended that the present invention encompass such changes and modifications as fall within the scope of the appended claims.

We claim:

1. A magazine for a firearm, comprising:

a zone for storing a plurality of cartridges in a first configuration, said first configuration comprising a double-X defined as a single stack cartridge configuration in which each cartridge contacts only a succeeding cartridge and a preceding cartridge with said contact being only at one location of each of said succeeding and preceding cartridges and in which said cartridges are crossed over each other by engaging portions of the cartridges proximate the nose ends using means for engaging while allowing the rim ends to move outwardly against sidewalls of the magazine;

said means for engaging nose ends of said cartridges comprising rails protruding inwardly from said sidewalls of the magazine proximate said nose ends of said cartridges;

a loading zone for holding said cartridges in a second configuration comprising a straight stack of said cartridges;

a transition zone for moving said cartridges from said first configuration to said second configuration; and means for moving said cartridges within the magazine.

2. The magazine of claim 1, wherein a gap between said rails is greater than a casing diameter of one of said cartridges.

3. The magazine of claim 1, wherein:

said rails are positioned approximately 0.700 inch from a rear end wall of the magazine.

4. The magazine of claim 1, wherein said transition zone comprises:

inwardly sloping sidewalls.

5. The magazine of claim 1, further comprising:

a loading ramp on an external surface of said loading zone proximate an open end thereof for assisting said cartridges into a firing chamber of the firearm.

6. A magazine for a firearm, comprising:

a zone for storing a plurality of cartridges in a first configuration, said first configuration comprising a double-X formed by means for engaging nose ends of said cartridges while opposite ends of said cartridges are allowed to separate;

a loading zone for holding said cartridges in a second configuration comprising a straight stack of said cartridges;

a transition zone for moving said cartridges from said first configuration to said second configuration;

said means for engaging nose ends of said cartridges comprising rails protruding inwardly from sidewalls of said magazine proximate said nose ends of said cartridges, wherein a gap between said rails is greater than a casing diameter of one of said cartridges, said gap comprising approximately 0.235 inch through said zone for storing and said transition zone and converges to approximately 0.230 inch in said loading zone; and means for moving said cartridges within the magazine.

7. A magazine for a firearm, comprising:

a zone for storing a plurality of cartridges in a first configuration, said first configuration comprising a double-X formed by means for engaging nose ends of said cartridges while opposite ends of said cartridges are allowed to separate;

said means for engaging nose ends of said cartridges comprising rails protruding inwardly from sidewalls of said magazine proximate said nose ends of said cartridges;

a loading zone for holding said cartridges in a second configuration comprising a straight stack of said cartridges, wherein said loading zone includes an angled ramp proximate an open end of the magazine to provide a force on said opposite ends of said cartridges to place each of said cartridges in a nose up condition prior to said cartridges passing through said open end;

a transition zone for moving said cartridges from said first configuration to said second configuration; and means for moving said cartridges within the magazine.

8. A magazine comprising:

a housing for retaining a plurality of cartridges, said housing having a storage zone, a transition zone, and a loading zone, wherein:

said storage zone comprises generally straight and parallel front and rear end walls and generally straight first and second sidewalls forming a first generally rectangular shaped chamber externally dimensioned to approximately match a magazine well on a firearm;

said transition zone, positioned between said storage zone and said loading zone, comprises said front and rear end walls and gradually inwardly sloping third and fourth sidewalls; and said loading zone comprises said front and rear end walls and fifth and sixth sidewalls forming a second chamber internally dimensioned to approximately match one of said cartridges, wherein said cartridges are in a double-X configuration in said storage zone, a straight stack configuration in said loading zone and are gradually transitioned from said first configuration to said second configuration by said transition zone;

a follower within sad housing for transferring a loading force to said cartridges;

a constant force spring attached to said follower and said housing to apply said loading force;

an open top end proximate said loading zone, said open top end having a surface formed at an angle approximately matching an angle between a longitudinal axis through said magazine well and a vertical axis; and a knob attached to said follower, said knob riding in a slot through said sidewalls.

9. The magazine of claim 8, wherein said angle of said surface of said open top end comprises:

20 degrees.

10. The magazine of claim 8, further comprising:

a loading ramp on said front end wall of said loading zone proximate said open end.

11. The magazine of claim 8, wherein said magazine well comprises:

a handgrip of a firearm.

12. The magazine of claim 8, further comprising:

inwardly protruding nose pads in said loading zone proximate said open end, said nose pads having a gap therebetween smaller than a diameter of one of said cartridges, wherein said nose pads help retain said cartridges within said open end.

13. The magazine of claim 12, wherein said gap comprises:

approximately 0.210–0.215 inch.

14. The magazine of claim 8, further comprising:

a pair of sloping ramps in said loading zone proximate said open end, wherein as one of said cartridges enters said loading zone, said ramps hold an end opposite a nose end of said cartridge while said nose end thereof is pushed toward said open end by said follower.

15. The magazine of claim 14, wherein said ramps further comprise:

extension lips therefrom along said open end having a gap therebetween smaller than a diameter of one of said cartridges.

16. The magazine of claim 15, wherein said gap comprises:

approximately 0.180–0.190 inch.

17. The magazine of claim 8, wherein:

said knob has an external surface approximately coplanar with an external surface of said sidewall of said storage zone and protruding beyond an external surface of said sloping sidewall of said transition zone.

18. The magazine of claim 8, wherein:

said transition zone has a length of approximately 0.510 inch.

19. The magazine of claim 8, wherein:

said loading zone has a length of approximately 0.470 inch.

20. The magazine of claim 8, wherein:

said first and second sidewalls are spaced apart approximately 0.445 inch.

21. The magazine of claim 8, wherein:

said fifth and sixth sidewalls are spaced apart approximately 0.280 inch.

22. The magazine of claim 8, wherein:

said constant force spring extends along said rear end wall.

23. The magazine of claim 8, wherein:

said constant force spring extends along said front end wall.

24. The magazine of claim 8, wherein said follower further includes:

protrusions extending from surfaces thereof for contacting said housing, wherein said protrusions push contaminants aside when said follower travels within said housing.

25. A magazine for use with a handgun having a generally rectangular shaped magazine well in which the well has a 20 angle between longitudinal and vertical axes passing therethrough, comprising:

a housing externally dimensioned to approximately match the rectangular shaped magazine well;

a storage zone in said housing for storing a plurality of cartridges in a double-X configuration;

a loading zone in said housing for arranging at least one of said cartridges in a loading position proximate an open end of said housing, said loading position comprising an approximate 25° angle between said cartridge and a horizontal axis through the handgun;

a transition zone in said housing between said storage zone and said loading zone for transitioning said cartridges from said double-X configuration to said loading position; and a spring loaded follower for moving said cartridges from said storage zone to said loading zone.

26. The magazine of claim 25, further comprising:

a loading ramp proximate said open end for guiding one of said cartridges from said loading position to a chamber of the handgun.

27. The magazine of claim 25, wherein said housing further includes:

inwardly protruding longitudinal rails positioned to contact said cartridges proximate nose ends thereof in order to place said cartridges in said double-X configuration.

28. A housing for a firearm magazine, comprising:

a storage zone for storing a plurality of cartridges;

a loading zone for positioning said cartridges for loading into a chamber of the firearm;

a transition zone between said storage zone and said loading zone for converting a first arrangement of said cartridges in said storage zone into a second arrangement in said loading zone;

a pair of inwardly protruding rails spaced a predetermined distance apart along opposite internal sidewalls of the housing, said rails positioned a predetermined distance from a rear end wall of the housing proximate nose ends of said cartridges and extending from said storage zone, through said transition zone and into said loading zone. said rails placing said cartridges in a double-X pattern in said storage zone;

nose pads protruding inwardly from said sidewalls proximate an open end of said loading zone to form a first gap therebetween;

ramps proximate said rear end wall in said loading zone for contacting ends of said cartridges, wherein said ramps help position said cartridges in a loading position proximate said open end;

extension lips from said ramps protruding inwardly from said sidewalls proximate said open end, said extensions forming a second gap therebetween, wherein said first and second gaps are less than a diameter of one of said cartridges; and an external loading ramp on a front end wall proximate said open end for assisting one of said cartridges from said loading zone to a chamber of the firearm.

29. The housing of claim 28, wherein:

said transition zone has a length of approximately 0.510 inch.

30. The housing of claim 28, wherein:

said loading zone has a length of approximately 0.470 inch.

31. The housing of claim 28, wherein:

said sidewalls are spaced apart approximately 0.445 inch in said storage zone and taper inwardly through said transition zone to a spaced apart distance of approximately 0.280 inch in said loading zone.

32. The housing of claim 28, wherein said predetermined distance between said rails comprises:

approximately 0.235 inch in said storage zone and said transition zone; and approximately 0.230 inch in said loading zone.

33. The housing of claim 28, wherein said predetermined distance said rails are spaced from said end wall comprises:

approximately 0.700 inch.

34. The housing of claim 28, wherein said first gap comprises:

approximately 0.210–0.215 inch.

35. The housing of claim 28, wherein said second gap comprises:

approximately 0.180–0.190 inch.

36. An improved connection for attaching a conforce spring to a firearm magazine, comprising:

a window through the magazine;

a first pin attached to said window;

means attached to said window spaced from and linearly offset from said first pin, wherein an end of the spring is draped over said first pin and a tip thereof is bent back over said means such that said means and said tip are removed from a path of said spring.

37. The housing of claim 36, wherein said means comprises:

a second pin.

38. A method for loading and unloading a plurality of cartridges, each having a nose end and an opposite end, into a storage zone of a magazine having a front end wall and a rear end wall, comprising the steps of:

loading and unloading the cartridges through an open end of the magazine; and arranging internal geometric relationships of the magazine to place the nose ends on one of the end walls of the magazine with the opposite ends of the cartridges off the end walls during loading and a reverse arrangement during unloading of the magazine, wherein frictional forces resisting loading and unloading are reduced.

39. A method for placing a first cartridge having a nose end and an opposite end in a "nose up" condition in an open end of a firearm magazine, comprising the steps of:

positioning the opposite end of the first cartridge against a ramp which angles toward the nose end;

pushing the nose end into a front end wall of the magazine with said ramp by applying a force on the first cartridge; and applying torque to the first cartridge by contact with a second cartridge and said ramp, wherein the first cartridge is placed in the "nose up" condition.

40. A method for configuring a plurality of cartridges in a magazine, comprising the steps of:

placing the cartridges between guide rails attached to sidewalls of the magazine, said guide rails positioned proximate a nose end of the cartridges;

separating rim ends of the cartridges into contact with alternate ones of said sidewalls, said sidewalls spaced a first distance apart in a storage zone, the cartridges being in a double-X configuration as a result of said guide rails, said double-X configuration comprising a single stack of said cartridges in which each cartridge contacts only a succeeding cartridge and a preceding cartridge with said contact being only at one location of each of said succeeding and preceding cartridges and in which said cartridges are crossed over each other by engaging portions of the cartridges proximate said nose ends using said guide rails while allowing said rim ends to move outwardly against said sidewalls; and moving said rim ends together through a transition zone into a straight stack configuration in a loading zone by said sidewalls converging to a second distance apart.

41. A method for providing cartridges to a firearm, comprising the steps of:

storing the cartridges in a double-X configuration in a storage zone of the magazine, said double-X configuration comprising a single stack of the cartridges wherein each cartridge contacts only a succeeding cartridge and a preceding cartridge with said contact being only at one location of each of said succeeding and preceding cartridges and in which the cartridges are crossed over each other by engaging portions of the cartridges proximate nose ends thereof while allowing rim ends thereof to move outwardly against the magazine sidewalls; and transitioning the cartridges through a transition zone to arrange the cartridges in a straight stack configuration, wherein the cartridges are provided to the firearm one at a time.

42. The method of claim 41, wherein the step of storing in a double-X configuration comprises:

holding portions of nose ends of the cartridges with rails spaced a first predetermined distance apart; and releasing ends opposite said nose ends of the cartridges into contact with sidewalls of said magazine in an alternating pattern, said sidewalls spaced a second predetermined distance apart, said second distance being greater than said first distance.

43. The method of claim 41, wherein the step of transitioning comprises:

forcing the cartridges through said transition zone in which said sidewalls converge from said second predetermined distance to a third predetermined distance, wherein said cartridges are moved into said straight stack configuration.

44. A method for removing obstructions from a magazine constant force loading spring, comprising the steps of:

draping a prebent end of the spring around a first pin attached to the magazine; and pushing a tip of said prebent end around a second pin attached to the magazine, wherein said second pin is offset from said first pin in order to remove said second pin and said spring tip from a path of said spring when extended into the magazine.

* * * * *